US007753759B2

(12) United States Patent
Pintor et al.

(10) Patent No.: US 7,753,759 B2
(45) Date of Patent: Jul. 13, 2010

(54) ARTICLE OF APPAREL FOR CONCEALING OBJECTS

(75) Inventors: Tammy Pintor, N89 W. 15963 Main St., Menomenee Falls, WI (US) 53051; Robert J. Pintor, Menomenee Falls, WI (US)

(73) Assignee: Tammy Pintor, Colgate, WI (US)

( * ) Notice: Subject to any disclaimer, the term of this patent is extended or adjusted under 35 U.S.C. 154(b) by 0 days.

(21) Appl. No.: 12/240,408

(22) Filed: Sep. 29, 2008

(65) Prior Publication Data

US 2009/0104845 A1 Apr. 23, 2009

Related U.S. Application Data

(60) Provisional application No. 60/981,577, filed on Oct. 22, 2007, provisional application No. 60/991,604, filed on Nov. 30, 2007.

(51) Int. Cl.
*A41C 3/00* (2006.01)

(52) U.S. Cl. ..... 450/89; 450/54

(58) Field of Classification Search ..... 450/1, 450/36, 37, 38, 54–58, 86, 88; 2/267, 268
See application file for complete search history.

(56) References Cited

U.S. PATENT DOCUMENTS

| | | | | | |
|---|---|---|---|---|---|
| 1,391,986 | A * | 9/1921 | Smith | 434/402 |
| 2,436,430 | A * | 2/1948 | Hart | 450/3 |
| 5,257,956 | A * | 11/1993 | Ewen | 450/1 |
| 5,496,205 | A * | 3/1996 | Lee | 450/89 |
| 6,517,409 | B2 * | 2/2003 | Flaherty | 450/1 |
| 7,118,444 | B2 * | 10/2006 | Newman | 450/58 |

* cited by examiner

*Primary Examiner*—Gloria Hale
(74) *Attorney, Agent, or Firm*—Boyle Frederickson, S.C.

(57) ABSTRACT

An article of apparent is disclosed comprising a pocket for concealing objects proximate to a breast.

13 Claims, 7 Drawing Sheets

ARTICLE OF APPAREL FOR CONCEALING OBJECTS

CLAIM OF PRIORITY

This application claims priority to U.S. Patent Appl. Ser. No. 60/981,577, "Brassiere for Concealing Electronic Devices and Other Functional Items While Retaining Smooth Contour," filed Oct. 22, 2007, and U.S. Patent Appl. Ser. No. 60/991,604, "Brassiere for Concealing Electronic Devices and Other Functional Items While Retaining Smooth Contour," filed Nov. 30, 2007, both of which are hereby incorporated by reference in their entireties for all purposes.

BACKGROUND

1. Field of the Invention

This invention relates generally to the field of brassieres, in particular brassieres containing concealed pockets for storing cell phones and other objects.

2. Description of Related Art

Cell phones, personal listening devices, and other mobile electronic devices have become popular in recent years. Many women carry these items in their brassieres ("bras") for convenience, as well as other objects such as money, keys, credit cards, or other objects that women may wish to keep concealed ("concealed objects"). However, bras and related products are generally not designed to carry such objects securely and comfortably. Pockets have been proposed for use within bras, but the placement of pockets and pocket structure have generally resulted in pockets that allow many objects to be seen due to the bulges or outlines created. Prior related art includes brassieres with a central pocket located between the cups, or pockets sewn into the front of the cups. These designs, however, cause the objects stored in the brassiere to become visible under clothing, especially larger items such as electronics. In addition, the central pocket causes the definition of each individual breast to be lost. Pockets covering much of the interior surface of the cups have also been proposed as means for receiving pads or prosthetics, but these are generally not designed for concealing, securing, and permitting convenient retrieval of various personal objects such as coins, keys, or cell phones. In general, the position, size, angle and configuration of previously proposed pockets may not be optimally designed to secure various concealed objects, and may not provide a suitable aesthetic appearance with pockets that are adapted to conceal bulk by their position, angle and construction. In particular, prior proposed bra pockets generally appear to lack have the ability, when containing concealed objects, to compress the breast tissue at a portion of the breast that achieves the effect of a smooth contour and minimal bulk.

Further, women who participate in athletic, work, childcare, walking, sports, errands or other activities may also desire the ability to listen to music devices without having to carry a purse or additional device to secure the music player to the wearer. In this situation, it is desirable to have a discrete storage area that will properly secure the music devices and/or other concealed objects, while allowing for a full range of movement for the wearer, and also allowing for convenient attachment of the object to headphones or other objects away from the bra. Women may also desire to maintain an aesthetic appearance that minimizes bulk, and retains a smooth breast contour and the appearance of clothing over the cellular phones, personal listening devices, lipstick and other cosmetics, medications and medical devices, multiple papers or dollar bills or a combination or plurality of the foregoing concealed objects.

Previous attempts have also been made to associate bras with portable medical devices such as diabetes pumps by connecting them bra straps or elsewhere, but these suffer from several drawbacks such as not being fully discrete and being difficult to access conveniently.

Thus, there is a need for a bra or related article of apparel with one or more pockets designed to hold cellular phones, personal listening devices, cosmetics, valuable items, medical objects, supplies, and other concealed objects securely so that they do not become lost or damaged. There is also a need for a bra or related article of apparel with one or more pockets that does not allow others to readily detect the presence of concealed objects in the pockets, or that does not create a bulky appearance to the breasts or clothing.

SUMMARY

An article of apparel has been developed for wearing in contact with the breasts of a wearer to securely hold and conceal objects therein through the use of a pocket positioned in a manner that results in objects inside the pocket pressing breast tissue on the upper lateral side of the breast, where the fatty breast tissue typically can be readily and comfortably deformed away from the object to minimize the visible bulk caused by the concealed objects, resulting in a natural appearance of the breast while compressed by the concealed objects. (As used herein, "lateral" is used in the anatomical sense to indicate being away from the center of the body, while "medial" indicates being toward the center of the body; thus a given breast has lateral side and a medial side.) It has been discovered that the pocket design of the present invention allows objects to be comfortably and securely carried while being substantially concealed by the article of apparel or by the article in combination with conventional clothing worn over the article of apparel.

In one aspect, the present invention is an article of apparel for wearing in contact with the breasts of a wearer, the article comprising a first breast cover having an outer surface and an inner surface, a medial side and a lateral side, and an upper portion and a lower portion, the breast cover being joined to breast cover support means attached to the upper torso of the wearer for holding the breast cover in place, the article further comprising a pocket layer having a perimeter, wherein a majority of the perimeter of the pocket layer is attached to the inner surface of the breast cover defining a pocket between the pocket layer and the inner surface of the breast cover, the pocket having a mouth for receiving objects to be carried in the article, wherein the pocket is disposed toward the lateral side of the breast cover with the mouth toward the upper lateral portion of the breast cover, such that when the article is worn on the body of a wearer with the breast cover held in place over a breast, an object received in the pocket is biased against the lateral side of the breast. The breast cover and other suitable components of the article of apparel may be formed from one or more plies of textiles or other materials known in the apparel arts, including woven fabrics such as those made from cotton, silk, polyester, and the like, nonwoven fabrics, padding materials, lace, mesh, and so forth.

The article of apparel may be a bra, sports bra, swimsuit, lingerie item, halter top, tank top, dress, or other item of clothing generally characterized by having a breast supporting section. A halter top, tank top, or dress of the present invention, for example, may comprise bra cups attached to the article to provide support which can then be provided with the pockets of the present invention. In some embodiments however, the article of apparel may exclude halter tops, tank tops, and/or dresses; in other embodiments the article of apparel may be limited to undergarments and swimwear.

The pocket can be formed of an extensible material that can, for example, elastically deform along at least one axis under mild loads (e.g., less than 3 pounds of force per inch of material width) to extents such as at least 10%, at least 20%, or at least 30% (e.g., when tested with a six-inch long strip one inch in length held between the jaws of universal testing device for measuring mechanical properties of textiles). Such materials can include woven or nonwoven fabrics comprising Spandex®, Lycra®, nylon, neoprene, polyurethanes, polyolefins, polyesters, wool, rayon, etc. The fabrics may be single layer or multilayer, including laminates and composites. The fabrics need not be substantially extensive and may be made of any soft, flexible material, including those commonly used for liners or interior surfaces of bra cups in bras, swimsuits, etc. The fabric may have an open area due to the presence of apertures (e.g., a mesh or lace) such that the area occupied by openings have a maximum diameter of at least 0.5 mm occupies at least 10% of the area of the material of the pocket layer. Open areas greater than 10% may be used, such as at least 20%, at least 30%, or at least 40%.

The pocket can be formed from a pocket layer that is substantially rectangular, rounded rectangular, or other suitable shape that has been attached to the interior surface of a breast cover using any known method such as sewing, ultrasonic welding, adhesive attachment, etc. The attachment of the pocket layer to the breast cover is along a portion of the perimeter of the pocket. The portion of the perimeter that is not directly joined to the breast generally defines the opening of the pocket for receiving objects, and can be oriented toward the top of the breast cover and near the upper boundary of the article that comprises the breast cover, allowing the user to reach under the upper boundary of the article and into pocket between the breast cover and the breast to retrieve or place objects, as desired.

The distance between the mouth of the pocket and the nearest upper boundary of the article can be less than 1 cm, less than 2 cm, or less than 3 cm, or may be between about 0.5 and 5 cm, such as between 0.5 and 4 cm or between 0.5 and 2 cm.

Rather than forming a pocket by joining a single pocket layer to the breast cover, the pocket layer itself may be part of a pre-formed pocket having a first body-side pocket layer co-extensive with a second pocket layer away from the body and toward the breast cover, with the first pocket layer joined to the second pocket layer along a portion of the perimeters of the first pocket layer to define an internal pocket chamber in the pre-formed pocket. The pre-formed pocket may then be attached to the interior surface of the breast cover by any known means such as stitching, thermal or ultrasonic welding, adhesives, etc. The resulting construct, for purposes of the present invention, will still be understood to have a pocket layer (i.e., the first pocket layer) joined to the breast cover along a perimeter of the pocket layer, though the joining in this case involves connection of the first pocket layer to an intermediate layer, the second pocket layer, which in turn is joined to the breast cover.

In many embodiments, the placement of the pocket toward the lateral side of the breast and its orientation and size keeps the pocket from covering the nipple of the breast to be more comfortable and aesthetically pleasing.

The pocket may further comprise securing means to close the pocket to reduce or eliminate the possibility of small objects falling from the pocket during use, including bending over. The securing means may comprise a flap providing a tortuous pathway for escape from the pocket, or a flap with mechanical attachment means to connect the flap to a surface of the pocket to achieve closure, or mechanical closure means to join the pocket layer to the breast cover. The attachment means can include hook and loop materials such as Velcro® (marketed by Velcro USA, Manchester, N.H.). Other attachment means may be used such as zippers, snaps, buttons, self-cohesive materials (e.g., opposing layers of cohesive silicone or other polymers), magnetic strips, etc. A pocket of the present invention in the breast cup of a swimsuit, for example, could be securable with a zipper or with a sewn strip over the lip of the pocket to constrain the contents of the pocket.

The pockets of the articles of the present invention may also comprise apertures or other means to allow cords, cables, wires, or tubes to pass from objects in the pockets to external locations. Thus, the user may carry an MP3 player or other personal listening device in the pocket of the article while listening to the music with earphones. Alternatively, a drug delivery device such as an insulin pump may deliver medication such as insulin via tube to another part of the body.

The articles of apparel of the present invention may include brassieres of any kind, sports bras and related active wear, swimsuits, halter tops, various undergarment foundations, lingerie, sportswear, or other clothing, including clothing into which support material serving the function of a brassiere has been incorporated and the like. In some embodiments, the breast cover comprises a flexible cup having a resilient shape adapted to provide support for the female breast such as a bra cup.

In general, a pocket of the present invention may be directly in contact with the breast of the wearer or may be further covered by one or more layers of lining material, padding, or other suitable materials.

Further, an individual pocket may be subdivided into multiple smaller pockets.

DETAILED DESCRIPTION OF THE DRAWINGS

Figure 1:
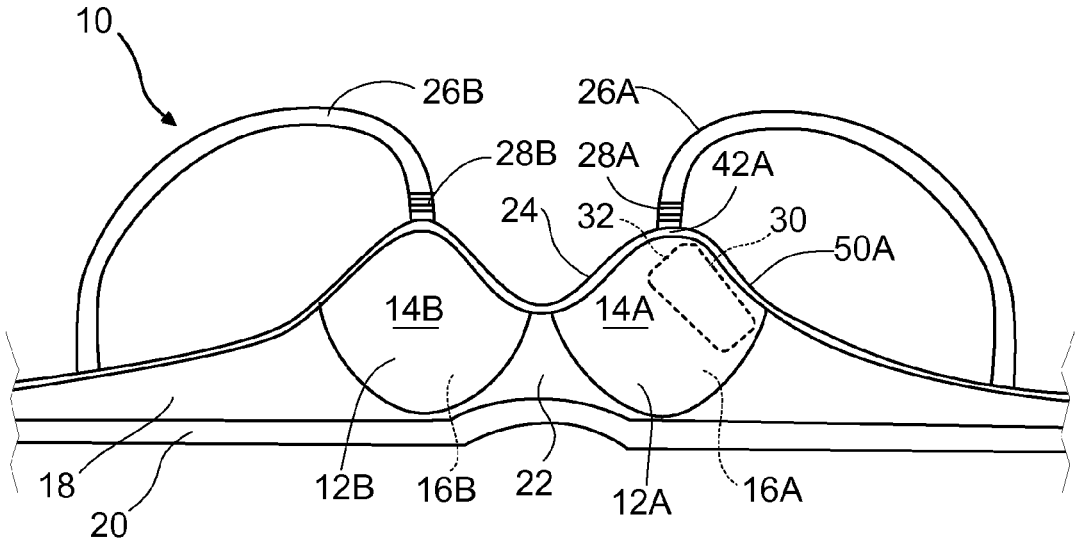
FIG. 1 is a front view of one embodiment of an article of apparel comprising a pocket for concealing objects.

For the purpose of promoting an understanding of the present invention, references are made in the text hereof to embodiments of a brassiere containing concealed pockets for concealing objects such as portable electronic devices, keys, toiletries, money and other valuables, pepper spray, insulin pumps, inhalers, syringes or other drug delivery devices, only some of which are depicted in the figures. It should nevertheless be understood that no limitations on the scope of the invention are thereby intended. One of ordinary skill in the art will readily appreciate that modifications such as the size and shape of the brassiere, the inclusion of fewer and/or additional elements, ornamental features, and the inclusion of additional breast enhancers are deemed readily apparent and obvious to one of ordinary skill in the art, and all equivalent relationships to those illustrated in the drawings and described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed system, structure, or manner.

It should be understood that the drawings are not necessarily to scale, emphasis instead being placed upon illustrating the principles of the invention. In addition, in the embodiments depicted herein, like reference numerals refer to identical or nearly identical structural elements in the various drawings.

Moreover, the term "substantially" or "approximately" as used herein may be applied to modify any quantitative representation that could permissibly vary without resulting in a change in the basic function to which it is related.

FIG. 1 provides a front view of the article of apparel 10 of the present invention, here in the form of a bra, which comprises two breast covers 12A, 12B, respectively, here in the form of bra cups, having exposed exterior surfaces 14A and 14B and opposing interior surfaces 16A, 16B for contacting the body. A medial portion 22 joins the two breast covers 12A, 12B, and a torso band 18 subtended by a lower torso strip 20 extends laterally outward from the breast covers 12A, 12B, terminating in S-hooks or other connection means (not shown) to join the two ends of the torso band 18 when worn. Shoulder straps 26A, 26B with strap adjustment means 28A, 28B, respectively, cooperate with the torso band 18 in securing the article 10 on the body of a wearer (not shown) to provide support for the breasts of the wearer (not shown).

A pocket 30 is provided on the interior surface 16A of a first breast cover 12A. The pocket 30 has a mouth 32 near the upper boundary 24 of the breast cover 12A of the article 10, with the mouth 32 accessible to a hand (not shown) reaching into the breast cover 12A between the shoulder strap 26A and the medial portion 22 of the article 10 (more specifically, between the point of attachment 42A of the shoulder strap 26A to the breast cover 12A and the medial portion 22 of the article 10). A majority of the pocket 30 is positioned toward the lateral side 50A of the breast cover 12A, remote from the medial portion 22 and toward the upper lateral portion of the breast (not shown), remote from the medial portion of the breast (not shown), such that objects in the pocket 30 will tend to compress the breast tissue on the upper lateral portion of the breast, and particularly the upper portion of the breast near the underarm where fatty breast tissue is predominant in many women, allowing the breast to be comfortably compressed to minimize bulk from concealed object (not shown). In practice, we have discovered that this tends to cause the breast to deform to receive the bulk of objects (not shown) in the pocket 30, rather than causing readily visible bulges in the article 10 due to the presence of the objects. Thus, objects can be readily concealed due to the placement and construction of the pocket 30, according to the present invention.

The breast covers 12A, 12B may include padding, decorative elements, breathable material, water-resistant or swimwear material, rigid or flexible support, elastics, support for cup enlarging inserts or prosthetics, or other additions known to the art.

Figure 2:
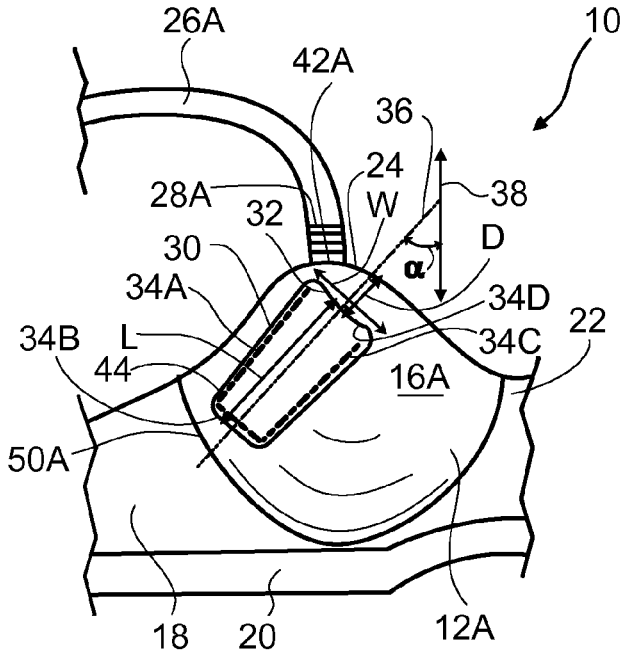
FIG. 2 is a back view of the article of FIG. 1.

FIG. 2 shows the interior side of a portion of the article 10 of FIG. 1. The pocket 30 is now visible on the interior surface 16A of breast cover 12A toward the lateral side 50A. The pocket 30 has a distorted rectangular shape with three sides 34A, 34B, and 34C attached to the breast cover 12A by stitches 44 (e.g., pearl stitches or any other suitable stitching), while a fourth side 34D remains free and defines the mouth 32 of the pocket 30. The shape of the mouth 32 is typically determined by the shape of the side 34D, which may be concave, as shown in FIG. 2, or may be substantially straight, convex, or have any combination of curved or linear components defining an aesthetically pleasing design. In use, however, it has been discovered that a somewhat concave shape to the mouth 32 can make it easier to slide objects into the pocket 30.

The pocket 30 has a length L extending from the side 34D defining the mouth 32 and the remote lower side 34B that terminates the pocket 30. The pocket 30 also has a width W shown here as the width at the mouth 32. The ratio of L/W is the pocket aspect ratio.

The pocket 30 also has a longitudinal axis 36 extending along the length L of the pocket 30. The angle $\alpha$ is the acute angle between longitudinal axis 36 and the vertical axis 38. In many embodiments, a finite acute angle $\alpha$ can assist in providing the proper positioning of the pocket such that the mouth 32 is readily accessible but that the majority of the pocket 30 is positioned to place objects on the lateral side of the breast (not shown), away from the centerline of the body (or away from the medial portion 22 of the article) to provide for lateral deformation of the tissue toward the lateral side of the breast located near the lateral side 50A of the breast cover 12A.

This orientation of the article 10 shown in FIGS. 1 and 2, with respect to defining the angle $\alpha$, should be understood to substantially correspond to the typical orientation that would be observed when the article 10 is worn on the body of wearer (not shown) standing upright with the sternum of the wearer substantially aligned with the vertical axis 38. In some embodiments, the angle $\alpha$, which can be called the offset angle, can range from about 10 degrees to about 70 degrees, such as from about 10 degrees to about 60 degrees, from about 10 degrees to about 50 degrees, from about 10 degrees to about 30 degrees, or from about 20 degrees to about 60 degrees, or greater than 10 degrees, greater than 20 degrees, or greater than 30 degrees.

Figure 3:
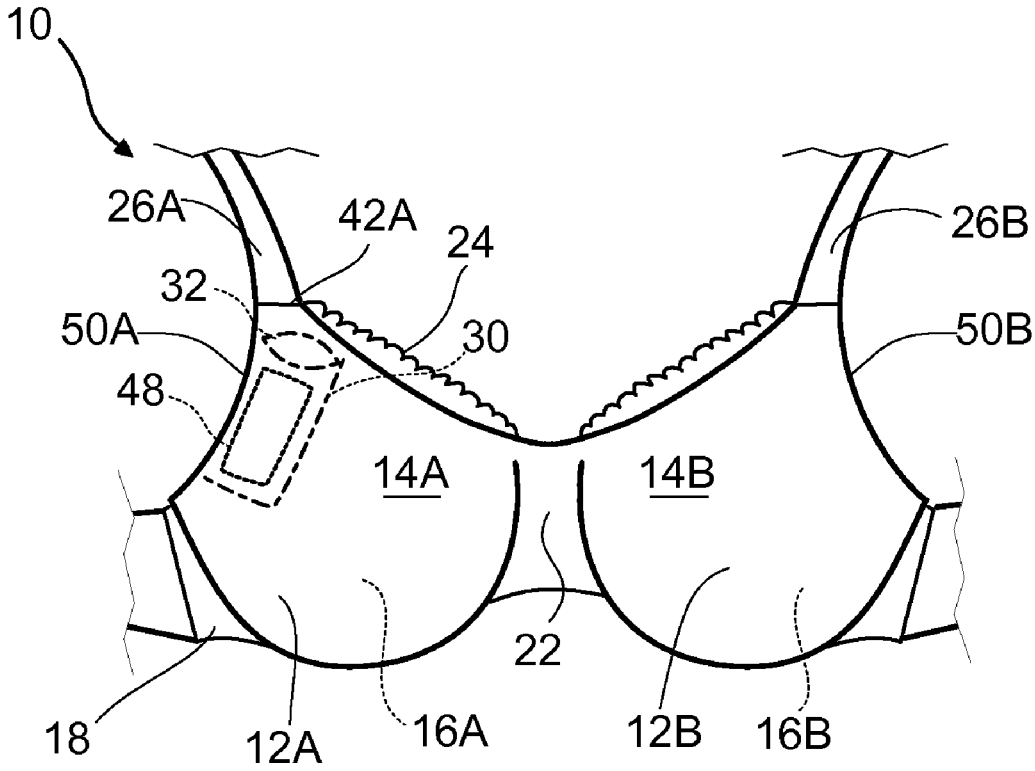
FIG. 3 shows a front view of another article of the present invention.

FIG. 3 shows another embodiment of the article 10 of the present invention, again in the form of an item of clothing such as a bra, swimsuit, or halter top. As in FIGS. 1 and 2, two breast covers 12A, 12B are joined by a medial portion 22 and are attached to shoulder straps 26A, 28B and a torso band 18. A pocket 30 is attached to the interior surface 16A of a first breast cover 12A and positioned on the lateral side 50A of the first breast cover 12A. Here one side of the pocket is coextensive with the lateral side 50A of the breast cover 12A. The pocket 30 is shown containing a concealed object 48.

Figure 4:
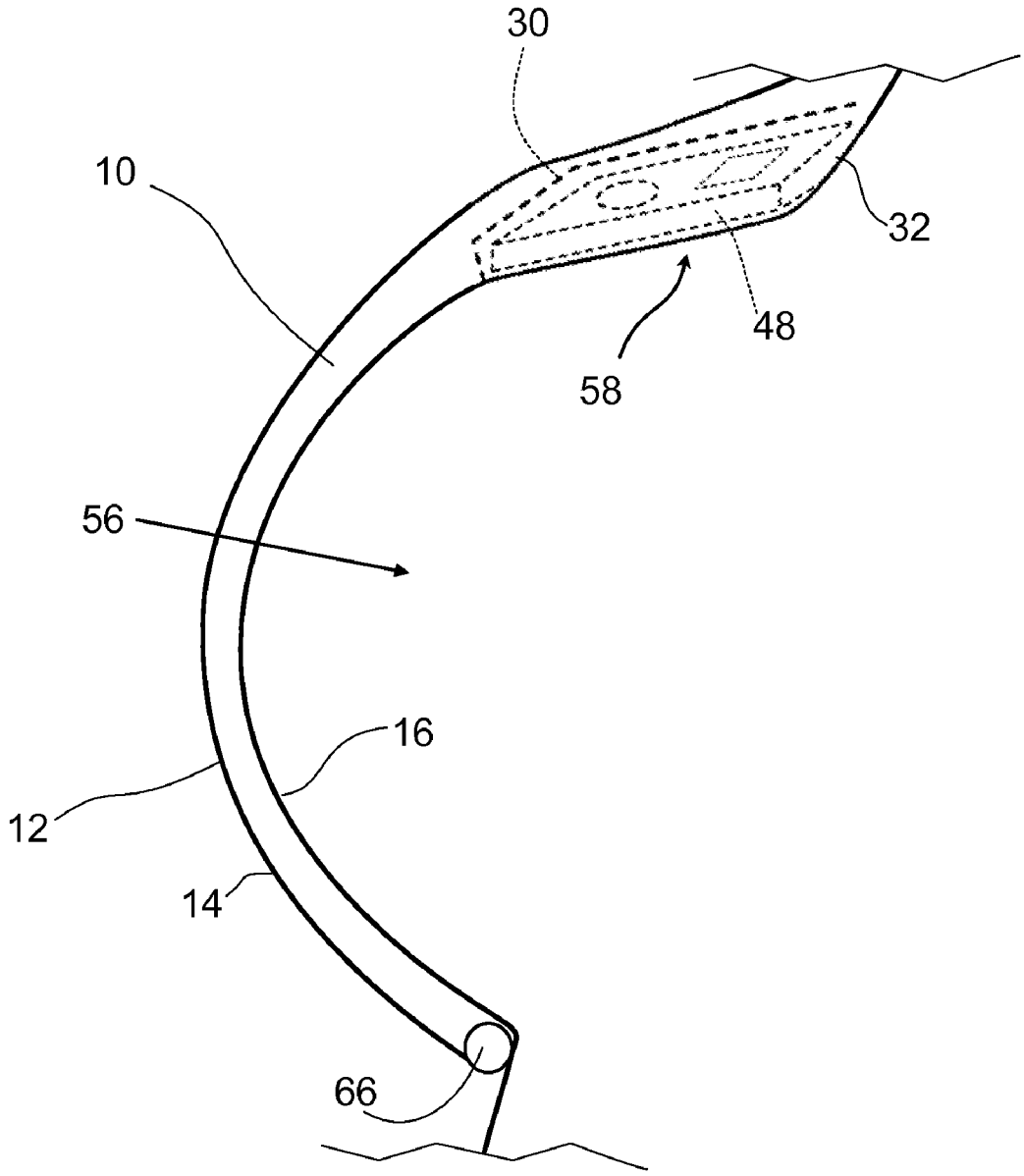
FIG. 4 shows a cross-section of a portion of an article of the present invention.

FIG. 4 is a cross-section of the lateral side of a breast 56 in contact with a portion of an article 10 of the present invention, showing a breast cover 12 having an interior surface 16 and an external surface 14, further having an underwire frame member 66 beneath the breast 56 (alternatively, various plastic, elastic, or other members may be used to provide added support). A pocket 30 is disposed between the upper portion of the breast 56 and the upper portion of the breast cover 12. The pocket 30 contains an object 48 which slightly deforms the breast 56 in deformed region 58 without causing a readily visible bulge or outline in the exterior surface 14 of the breast cover 12.

Figure 5:
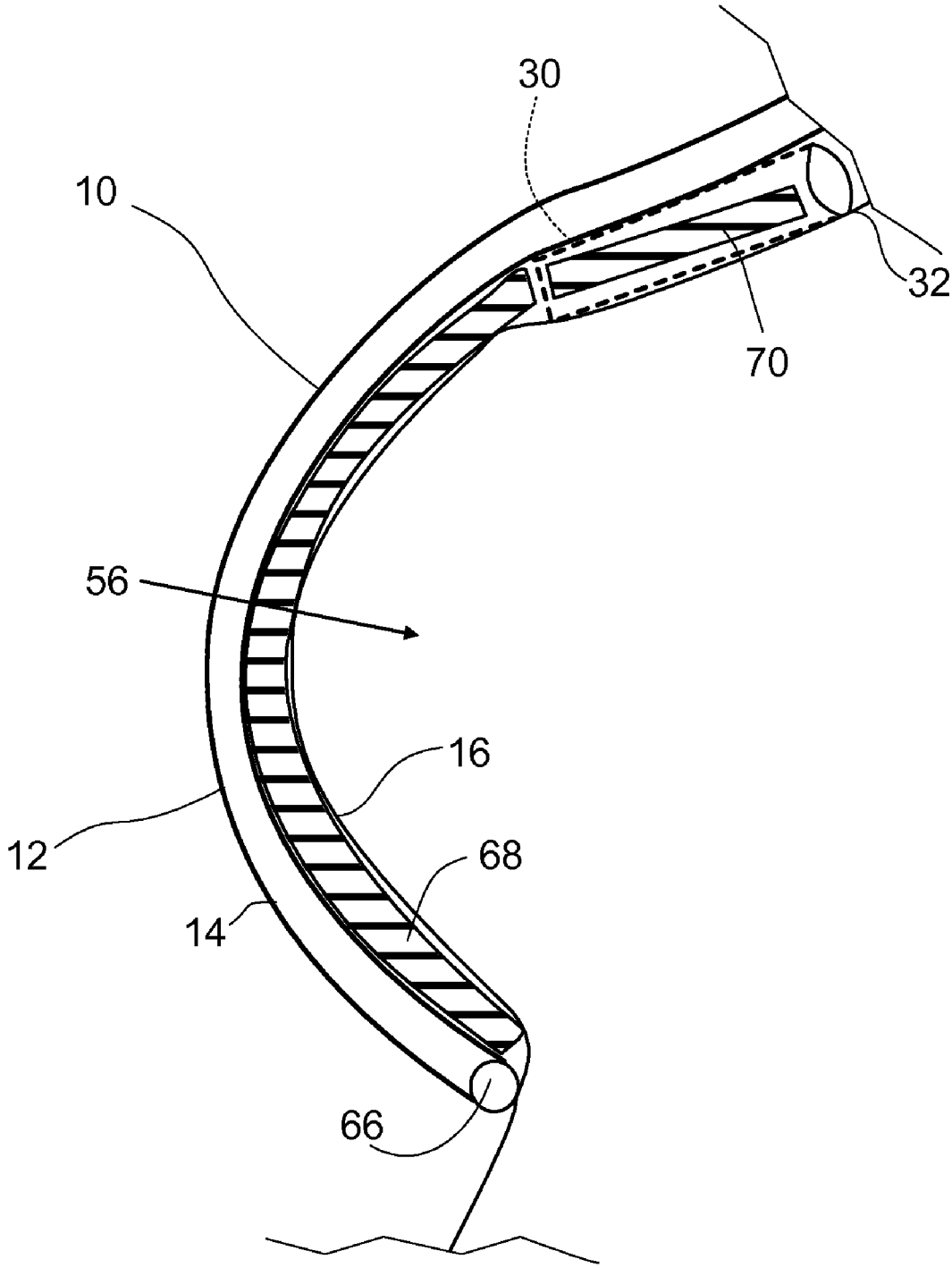
FIG. 5 shows a cross-section of a portion of an article of the present invention comprising a padding layer.

FIG. 5 is a cross-section similar to that of FIG. 4, but wherein the article 10 is a padded bra wherein the breast cover 12 further comprises a layer of padding 68 under the interior surface 16. In contrast to FIG. 4, no object is shown in the pocket 30. Rather, the pocket 30 is filled with a removable section of padding material 70 that may comprise the same type of padding material used to form the padding layer 68 of the article 10. When it is desired to insert an object (not shown) into the pocket 30, the removable section of padding material 70 may be removed to provide additional volume for concealed objects, further assisting the wearer in concealing objects without providing a bulky appearance from their presence.

Figure 6:
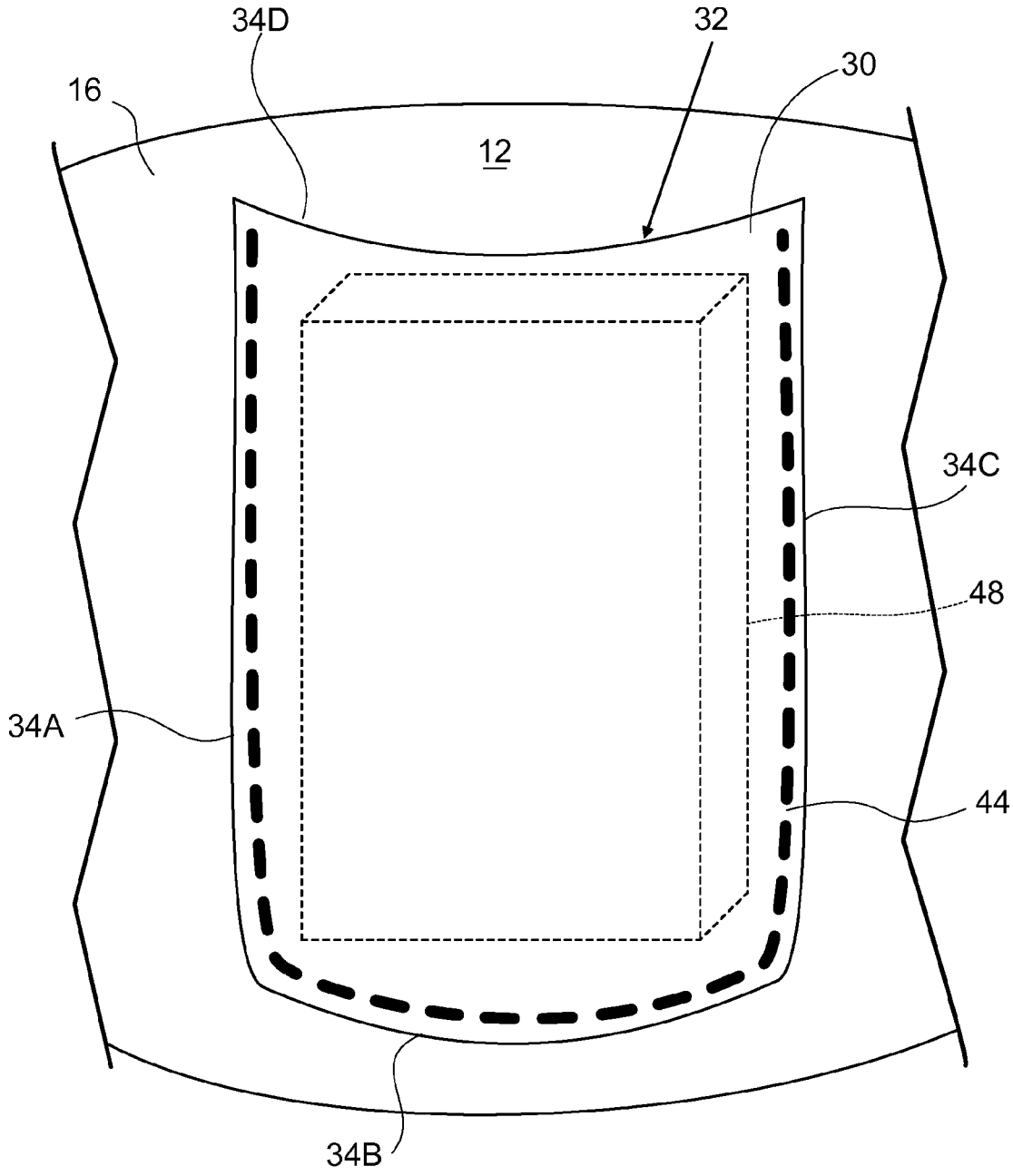
FIG. 6 shows a detail of a pocket in an article of the present invention.

FIG. 6 shows a detail of a pocket 30 attached to the interior surface 16 of a breast cover 12, having a first side 34A, a second side 34B, a third side 34C, and a fourth side 34D that interacts with the interior surface 12 to forms the mouth 32 of the pocket 30, here having a concave shape. The sides 34A, 34B, 34C are joined to the interior surface 16A with stitches 44 though many other attachment means could be used. The pocket 30 is shown holding a concealed object 48.

Figure 7:
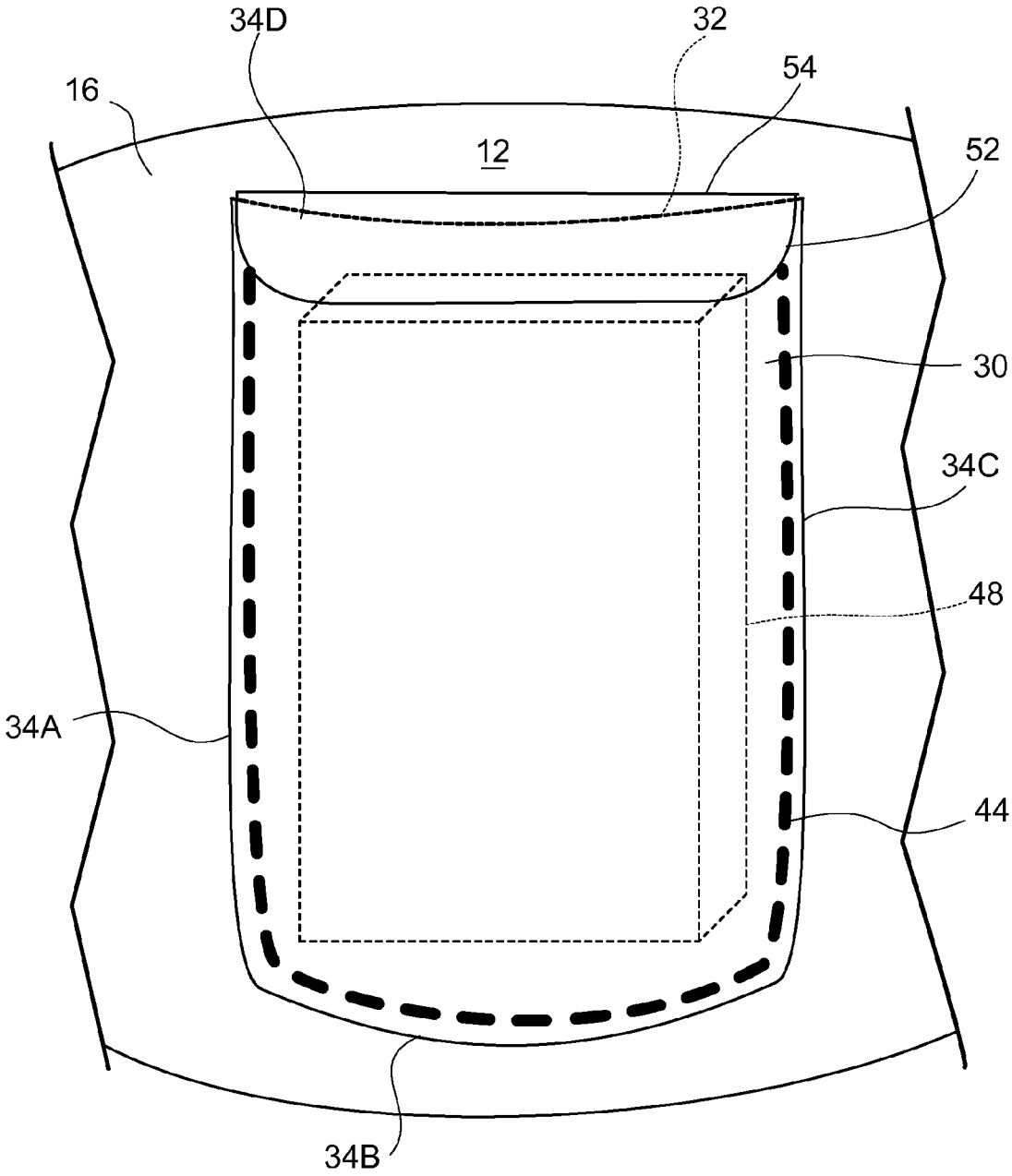
FIG. 7 shows a detail of a pocket having a flap.

FIG. 7 shows a detail of a pocket 30 similar to that of FIG. 6 except here the pocket 30 further comprises a flap 52 attached to the interior surface 16 of the breast cover 12 along a flap line 54. The flap 52 is shown in the closed position, providing additional restraint to prevent a concealed object 48 from falling out of the interior of the pocket 30.

Figure 8:
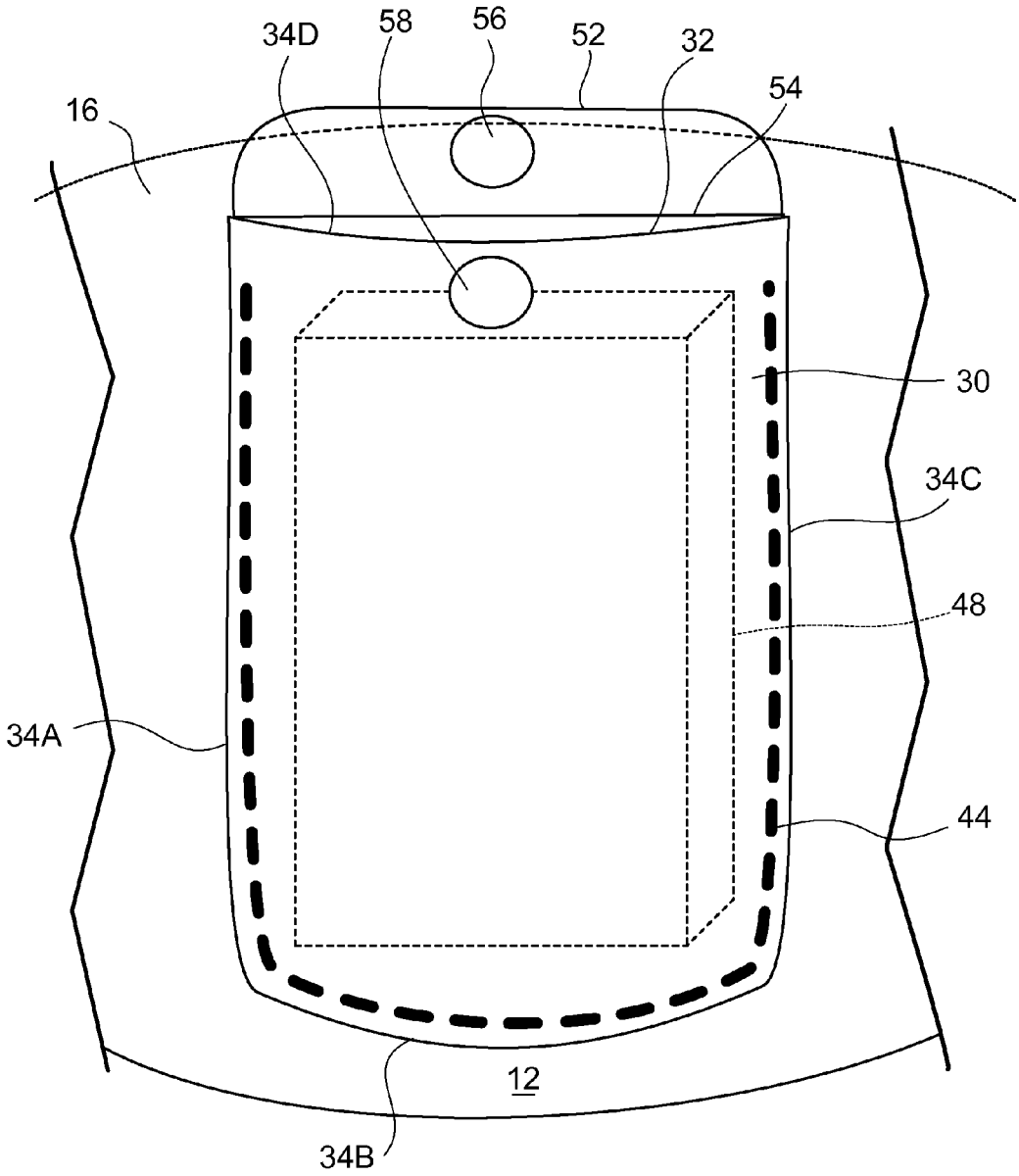
FIG. 8 shows a detail of a pocket having closure means to secure the flap in a closed position.

FIG. 8 shows a detail of a pocket 30 similar to that of FIG. 6 but with additional mechanical closure elements 56, 58 in the form of a first closure element 56 and a second closure element 58, wherein the first and second closure elements 56, 58 cooperate to securely close the flap 52 onto the pocket 30. The first and second closure elements 56, 58 may be a hook layer and a loop layer in a hook-and-loop mechanical closure system such as a Velcro® attachment system, a snap and snap receiving element, a magnet and metallic element attracted by magnets, two opposing layers of a cohesive material, and the like. Pockets 30 having such closure elements 56, 58 can be implemented in articles of apparel suitable for athletic activities, swimming, or wherever there is an elevated risk of objects falling from a pocket 30.

Further Details

The present invention may be adapted for nursing bras and related garments, such as those described in U.S. Pat. No. 3,449,763 to Grate, issued Jun. 17, 1969; U.S. Pat. No. 4,208,743 to Whitcraft, issued Jun. 24, 1980; U.S. Pat. No. 6,361,398 to Knapp, issued Mar. 26, 2002; and U.S. Pat. No. 5,611,086 to Eggen, issued Mar. 18, 1997. The present invention may also be adapted for strapless bras such as those described in U.S. Pat. No. 3,204,638, "Strapless Brassiere," issued Sep. 7, 1965 to W. Jean. Women's swimming suits, either the top portion of two-piece suits or one-piece suits, may also be adapted for use with the present invention. The material of construction for the breast covers or other portions of the article of apparel may comprise an elastomeric woven or nonwoven material, including spandex, materials comprising Lycra® fiber (marketed by Invista Corp., Wichita, Kans.), polyurethane, nylon, polyolefins, and the like, or it may be a woven or nonwoven or composite thereof without substantial elastomeric properties. The material of construction for the breast cover or the pocket itself may have substantial uniaxial or biaxial stretch.

Among the many varieties of bras that may be used with the present invention, underwire bras may be of any known kind, and may include underwires comprising metal, plastic, or other materials. Examples that may be adapted for use within the scope of the present invention include U.S. Pat. No. 4,133,316, "Brassiere Frame," issued Jan. 9, 1979 to H. L. Schwartz, which describes a protective device for the end of a narrow flat arcuate wire in the pocket of a brassiere for framing the lower circumferential portion of a brassiere cup.

The bra may be constructed according to principles given in any of the following patents:

- U.S. Pat. No. 3,244,175, "Brassiere Construction," issued to May 11, 2004 to H. Sturges;
- U.S. Pat. No. 6,733,362, "Brassiere," issued to K. Plew; which describes a brassiere of the type having a pair of cups, torso bands, and shoulder strap, and apparatus for connecting the pair of shoulder straps, wherein said apparatus includes a strip of fabric loops extending along free upper edges of the pair of torso bands and free upper edges of the pair of cups, a pair of fabric loops that are overlying aligned with each other, and disposed in a space between the pair of cups at free upper edges of the pair of cups, an upper strip of material that may be silicone overlying the strip of fabric loops and the pair of fabric loops for preventing discomfort to a wearer and keeping the brassiere in place, and a lower strip of material such as silicone that overlies the free lower edges of the pair of torso bands for further keeping the brassiere in place.
- U.S. Pat. No. 7,413,495, "Bra and/or Bra Pad for Providing the Appearance of Symmetry to Asymmetrical Breasts," issued Aug. 19, 2008 to M. Sobah-Wilhelm, which describes an apparatus comprising a strap portion, a first cup, and a second cup. The first cup may be connected to the strap portion and may be selected from a number of available sizes. The second cup may be connected to the strap portion and selected from a number of available sizes. The first cup and the second cup are different sizes.
- U.S. Pat. No. 3,935,865, "Brassiere," issued Feb. 3, 1976 to J. Newmar.
- U.S. Design Pat. D438691, "Sports Bra," issued Mar. 13, 2001 to A. Zagame.
- U.S. Pat. No. 4,816,005, "Sports Bra," issued Mar. 28, 1989 to R. Braaten.
- U.S. Pat. No. 2,005,094 issued Zweben, which describes an apparel garment adapted to extend around wearer, a unitary tape forming shoulder straps, the ends of which are respectively connectible to the front right and left-hand portions of the same, the back of the garment being constructed to include therein a plurality of circumferentially spaced openings, through any pair of which the tape freely passes to afford the wearer adjustment for the amount of circumferential extension of the tape at the back of the garment.
- U.S. Pat. No. 2,882,907 to Puliafico, which describes a shoulder strap-type garment that comprises a garment body having a pair of cups with body-facing surfaces having free upper edges and a pair of torso bands with body-facing surfaces having free upper edges and free lower edges and extending from the pair of cups, respectively, a pair of shoulder strap having ends with S-hooks thereon, and means 34 separably and adjustably connecting the pair of shoulder straps to the garment body. The means comprises a tape extending longitudinally on the upper edge portion of the body so that the upper edge portion of the body underlies the full width of the tape. Parallel lines of stitching extend through both longitudinal edges of the tape and secure the same to the body. The tape includes a zig-zag element affording a longitudinal extending row of loops between the lines of stitching. A hook-shaped member is separably and selectively connectible with the loops for adjusting the point of attachment of the shoulder strap to the body in a direction longitudinally of the tape. Then upper edge portion of the body underlies and secured to the tape of the lines of stitching serving to hold the tape flat against the body to resist accidental separation of the connecting member therefrom.

U.S. Pat. No. 5,024,628 issued to Sanchez which describes a maternity and nursing bra. Also incorporated into the inside of the inner cup is an optional use nursing pad pocket. The bra's variable strap width adjusting band and the relocatable shoulder straps enable the bra to be worn with a variety of outer garment styles.

In other embodiments, the pocket may contain additional concealed pockets, or may have pockets which are smaller or larger, and may be located in other concealed area, such as in a shoulder strap, and may have different configurations or angles to provide the desired effect for woman having larger or smaller breasts and varying body types.

While an article of apparel may have a relatively simple color scheme such as an all-white bra, the interior pocket or pockets may be provided with various indicia or other design elements for aesthetic effect. Thus, a pocket may be printed, embroidered, dyed, or have added elements attaches to define logos or other aesthetic elements that may be associated with selected themes, sports teams, holidays (e.g., Valentines Day), colleges, high schools, communities, hobbies, favorite television shows, celebrities, and the like.

The pocket or pockets in an article of apparel may be adapted to receive any useful objects of suitable size. The sides of the pocket need not be straight or parallel, but may define arbitrary shapes such as trapezoids, truncated ovals, S-shapes, and the like.

In other embodiments, the articles of apparel of the present invention may comprise one or more pocket suitable for carrying and concealing personal care items such as tampons.

Health care devices may be used, and in some embodiment, a first breast cover of the article of the present invention may comprise a pocket for concealing a medical device such as an insulin pump, the pocket being adapted with a cord opening to allow an insulin tube to pass through to the location in insulin injection on the body (i.e, to the cannula through which insulin is administered subcutaneously to the wearer), while a second pocket in a second breast cover can be adapted to carry related health care supplies such as additional insulin, a blood glucose monitor, a syringe, other medication, a test device, etc. Thus, in some embodiments, the bra pockets of the present invention can be adapted to meet various needs of diabetics.

The insulin pump may be any known insulin pump, such as those the following devices: the Accu-Chek Spirit® (Disetronic Medical Systems Inc., Fishers, Ind.), the Animas Ping® (Animas Corp., West Chester, Pa.), the DANA Diabecare® IISG (Sooil USA, San Diego, Calif.), the Minimed Paradigm® 522/722 (Medtronics, St. Paul, Minn.), and the Nipro Amigo (Nipro Corp., Osaka, Japan).

While the article of apparent containing one or more concealed pockets for storing objects has been shown and described with respect to several embodiments in accordance with the present invention, it is to be understood that the same is not limited thereto, but is susceptible to numerous changes and modifications as known to a person of ordinary skill in the art, and it is intended that the present invention not be limited to the details shown and described herein, but rather cover all such changes and modifications obvious to one of ordinary skill in the art.

We claim:

1. An article of apparel for wearing in contact with the breasts of a wearer, the article comprising a pair of breast covers; each breast cover having an outer surface and an inner surface; a medial side and a lateral side; and an upper portion and a lower portion, each breast cover being joined to breast cover support means attached to the upper torso of the wearer for holding the breast cover in place; a layer of padding encompassed between the inner surface of the breast cover and the outer surface of the breast cover; the inner surface of each breast cover being the innermost side of the breast cover that lies adjacent to the wearer's body; wherein the inner surface of each breast cover defines a wearer's body side surface lying against the skin of the wearer and a padding side surface facing toward the layer of padding; the article further comprising a pocket layer having a perimeter; wherein a majority of the perimeter of the pocket layer is attached to the wearer's body side surface of the inner surface of at least one breast cover such that the pocket layer is located between a wearer's breast and the wearer's body side of the inner surface of the breast cover defining a pocket between the pocket layer and the wearer's body side surface of the inner surface of the breast cover; the pocket having a mouth for receiving objects to be carried in the article; wherein the pocket is disposed toward the lateral side of the breast cover with the mouth toward the upper lateral portion of the breast cover; wherein the pocket layer is attached to the wearer's body side surface of the inner surface of the breast cover at an angle of about 10 degrees to about 30 degrees and laterally located relative to the center of the breast cover; such that when the article is worn on the body of a wearer with the breast cover held in place over a breast; an object received in the pocket is biased against the lateral side of the breast, so that the pocket deforms inwardly toward the skin surface of the wearer, and the object is concealed from view.

2. The article of claim 1, wherein the pocket further comprises closure means for closing the pocket.

3. The article of claim 2, wherein the closure means are selected from hook and look closures, a zipper, a snap, self-cohesive material, and magnetic materials.

4. The article of claim 2 wherein the closure means comprise a flap that lies over the mouth of the pocket.

5. The article of claim 1, wherein the pocket comprises an extensible material capable of elastic deformation of at least 10% in length along at least one axis of the extensible material.

6. The article of claim 1, wherein the article is one of a sports bra and a swimsuit.

7. The article of claim 1, wherein the article is one of a halter top, tank top, and a dress.

8. The article of claim 1, wherein the pocket layer is connected to a second pocket layer to define a preformed pocket, and wherein the second pocket layer is attached to the body side of the inner surface of the breast cover.

9. The article of claim 1, wherein the pocket has a length to width ratio of at least 1.5, and has a length of at least 8 cm.

10. The article of claim 1, wherein the center of the mouth of the pocket is disposed at least 4 cm to lateral side of the center of the breast cover.

11. The article of claim 1, further including a removable section of padding material adapted to fit with in the pocket, such that the padding can be inserted to provide a substantially uniform coverage of padding over the breast of the wearer.

12. A method of concealing objects adjacent to a female breast, comprising: forming a breast cover having an innermost surface layer that is adjacent to the skin surface of a wearer; wherein the breast cover includes a lateral side and a medial side; attaching a support means to the breast cover; attaching a pocket layer to the lateral side of the innermost surface layer of the breast cover such that the pocket layer is adjacent to the skin surface of a wearer, forming a pocket such that the pocket does not cover a nipple on the breast and wherein the pocket layer is affixed on an angle such that a closed end is further lateral than a mouth of the pocket layer and wherein the pocket further having an aspect ration of at least about 1.5; receiving an object in the pocket; biasing the object against the skin surface of the wearer, deforming the pocket inwardly toward the skin surface of the wearer, and concealing the object from view.

13. An article of apparel for wearing in contact with the breasts of a wearer, the article comprising a pair of breast covers, the pair of breast covers having a pair of lateral sides defining a distance therebetween that corresponds to a width dimension of the article; the lateral sides of the breast covers defining upper and lower portions thereof; each breast cover including:

an exterior surface facing away from the wearer;

an interior surface facing toward the wearer;

a padding layer being disposed between the exterior and interior surfaces of the breast cover; and wherein at least one of the breast covers includes a pocket that is attached thereto and is located within the upper portion of the lateral side of the breast cover, the pocket overlying a portion of the interior surface of the breast cover such that the pocket sits between the breast of the wearer and the interior surface of the breast cover; the pocket including:

a mouth being configured to receive objects to be carried within the pocket;

a longitudinal axis extending along a length of the pocket; and an offset angle defined between the longitudinal axis of the pocket and a vertical axis extending upwardly through the breast cover, the offset angle having a magnitude of about 10 degrees to about 30 degrees.

* * * * *